US006006933A

United States Patent [19]

Henning et al.

[11] Patent Number: 6,006,933

[45] Date of Patent: Dec. 28, 1999

[54] TWIST-OFF CLOSURE

[75] Inventors: John C. Henning, Fairfield; Mark E. Melson, Cincinnati, both of Ohio

[73] Assignee: Product Investment, Inc., Cincinnati, Ohio

[21] Appl. No.: 09/065,136

[22] Filed: Apr. 23, 1998

[51] Int. Cl.[6] ..... B65D 41/14

[52] U.S. Cl. ..... 215/328; 215/326; 215/333; 215/353

[58] Field of Search ..... 220/309.1, 309.2; 215/263, 272, 317, 319, 321, 324, 326, 327, 328, 329, 333, 336, 339, 341, 352, 307, 316, 353

[56] References Cited

U.S. PATENT DOCUMENTS

| | | | |
|---|---|---|---|
| 468,226 | 2/1892 | Painter . | |
| 1,485,136 | 2/1924 | House . | |
| 1,673,485 | 6/1928 | Berge . | |
| 1,693,117 | 11/1928 | McDonnell . | |
| 1,796,728 | 3/1931 | Sharp . | |
| 1,796,729 | 3/1931 | Sharp et al. . | |
| 2,014,033 | 9/1935 | Smith . | |
| 2,069,075 | 1/1937 | Lunn . | |
| 2,106,464 | 1/1938 | Meyer . | |
| 2,161,993 | 6/1939 | Berch et al. | 215/324 |
| 2,173,785 | 9/1939 | Kniesche . | |
| 2,304,826 | 12/1942 | Jackson . | |
| 2,357,416 | 9/1944 | McManus et al. . | |
| 2,404,793 | 7/1946 | Dickerman . | |
| 2,726,001 | 12/1955 | Cululi . | |
| 2,776,065 | 1/1957 | Loretitsch . | |
| 2,792,957 | 5/1957 | Rodriguez . | |
| 2,974,704 | 3/1961 | Rheingold et al. . | |
| 3,077,280 | 2/1963 | Foss et al. . | |
| 3,147,875 | 9/1964 | Rutledge, Sr. | 215/328 |
| 3,198,369 | 8/1965 | St. Jacques . | |
| 3,346,134 | 10/1967 | Leemann . | |
| 3,348,405 | 10/1967 | Johnson . | |
| 3,410,435 | 11/1968 | Kopczynski | 215/324 |
| 3,497,098 | 2/1970 | Myer . | |
| 3,633,781 | 1/1972 | Zapata | 215/324 |
| 3,650,026 | 3/1972 | Freeman . | |
| 3,710,666 | 1/1973 | Keyes et al. . | |
| 3,868,038 | 2/1975 | Hadley . | |
| 3,903,934 | 9/1975 | Vizy . | |
| 3,993,108 | 11/1976 | Kirschenman et al. . | |
| 4,055,266 | 10/1977 | Amabili . | |
| 4,100,788 | 7/1978 | Morini . | |
| 4,114,775 | 9/1978 | Shinozaki . | |
| 4,198,884 | 4/1980 | Nakagawa et al. . | |
| 4,277,994 | 7/1981 | Gargrave . | |
| 4,543,865 | 10/1985 | Kramski . | |
| 4,595,110 | 6/1986 | Herr . | |
| 4,699,285 | 10/1987 | Perne et al. . | |
| 4,726,483 | 2/1988 | Drozd . | |
| 4,779,749 | 10/1988 | Geiger . | |
| 4,782,969 | 11/1988 | Henning . | |
| 4,909,721 | 3/1990 | Warburton . | |
| 4,945,953 | 8/1990 | Kronberg . | |
| 5,190,178 | 3/1993 | Luch . | |
| 5,263,600 | 11/1993 | Henning . | |
| 5,415,306 | 5/1995 | Luch et al. . | |
| 5,458,158 | 10/1995 | Kawanabe . | |
| 5,492,001 | 2/1996 | Sasaki et al. . | |
| 5,806,700 | 9/1998 | Henning | 215/328 |

*Primary Examiner*—Allan N. Shoap
*Assistant Examiner*—Niki M. Eloshway
*Attorney, Agent, or Firm*—Wood, Herron & Evans L.L.P.

[57] ABSTRACT

A twist-off closure for use with a bottle having a neck, a lip and a ledge surrounding the neck and a plurality of ramp sections. The closure includes a top wall, a skirt and a plurality of tabs extending from the bottom edge of the skirt. The tabs are T-shaped and include a cross arm extending adjacent to the free end of the stem. The cap is made from a steel sheet coated with tin and a varnish or lacquer layer with the edges of the cap being formed by pinch trimming so that a corrosion-resistant layer of tin substantially covers the edges.

11 Claims, 6 Drawing Sheets

TWIST-OFF CLOSURE

BACKGROUND OF THE INVENTION

The present invention relates to improvements in twist-off closures for bottles and other containers. The invention is particularly directed to tamper-evident twist-off closures which provide a readily observable indication that the container has previously been opened so that a user will be forewarned that the contents of the container may have been adulterated.

The present invention is particularly directed to improvements on the type of tamper-evident twist-off closures which include a plurality of tabs extending inwardly and upwardly from the closure skirt when the closure is in a sealed position in such a manner that the tabs are compressed against a ledge formed on the bottle to hold the cap, also referred to as a "crown", firmly in place. The closure is removed by initially rotating it with the result that the tab ends are shifted outwardly by cams formed on the bottle neck. Thereafter, the cap is lifted free of the bottle. In practice, once the cap has been removed, it cannot be re-locked on the bottle except with the aid of a relatively cumbersome and complicated machine which would not be available to someone seeking to surreptitiously open and re-seal a bottle. Various forms of caps and bottles of the general type described above are shown in Henning, U.S. Pat. No. 4,782,469 for TWIST-OFF BOTTLE CAPS, Henning, U.S. Pat. No. 5,263,600 for TAMPER-EVIDENT TWIST-OFF CLOSURE and the pending United States Patent Application of John C. Henning, Ser. No. 08/697,426 for TAMPER-EVIDENT CLOSURE SYSTEM.

More particularly, the closure shown in Henning, U.S. Pat. No. 4,782,469 includes a top wall, and a depending skirt having a plurality of narrow tabs extending from its lower edge. These tabs are generally rectangular and include a serrated outer edge. When the cap is applied to the bottle, the tabs are bent upwardly and inwardly to engage surfaces formed on the neck of the bottle below an endwise lip. These tabs are thus placed in compression, and thereby hold the cap tightly sealed against the upper lip of the bottleneck. The cap is removed by an initial twisting motion during which the tab ends are shifted outwardly, followed by a lifting motion to free the cap from the bottle.

The closure shown in Henning, U.S. Pat. No. 5,263,600 comprises a flat top, a depending ribbed skirt, and narrow tabs extending from the edge of the skirt. The tabs shown in this patent are generally rectangular with their outer edges being slightly asymmetrical relative to the centerline of the tab. These tabs are adapted to engage a shelf formed on a bottle with which the cap is used. These tabs are thus placed in compression, and function to hold the cap in position by compression in generally the same manner as the cap disclosed in U.S. Pat. No. 4,782,969.

Another cap construction incorporating generally rectangular tabs is shown in the co-pending patent application of John Henning for TAMPER-EVIDENT CLOSURE SYSTEM, Ser. No. 08/697,426. The tabs provided on the cap shown in that application extend from the edge of a skirt and have an outer edge which is slightly curved to facilitate its sliding engagement with a cooperating ledge on the bottle. The tabs are bent inwardly and upwardly to engage the ledge in such a manner that the tabs are compressed when the cap is in its closed, sealed position, and thereby function to hold the upper wall of the cap tightly against the upper lip of the bottle. The caps and bottles shown in Henning application Ser. No. 08/697,426 function extremely well when a cap is applied to the bottle. The caps are effective to retain internal bottle pressures in excess of the industry standard. The caps can be removed with a torque within an acceptable range and can be completely removed from the bottle in an easy manner. Moreover, once a cap has been removed, it cannot be replaced upon the bottle and resealed without the use of extremely cumbersome equipment. Consequently, when a user attempts to replace the cap, it remains relatively loose, providing clear and unmistakable evidence that the cap has previously been removed.

However, the cap shown in Henning application Ser. No. 08/697,426 for TAMPER-EVIDENT CLOSURE SYSTEM remains subject to one disadvantage in use. More particularly, the edges of the tabs and periphery of the skirt have shown a tendency to rust, rendering the bottle and cap somewhat unattractive. We have determined that this rusting is due to the accumulation of moisture on the inwardly bent tabs and inner surface of the cap skirt following the immersion of filled bottles in a sterilizing bath after the bottles have been filled and capped. As is well-known to those skilled in the art, after bottles have been filled with a beverage such as beer and the caps secured in place, the bottles are transported through a bath of hot liquid. Following this, air jets are directed against the caps to dry them and prevent rusting. We have determined that this drying procedure is not effective to prevent rusting of the prior art caps shown in the above-identified Henning application Ser. No. 08/697,426.

SUMMARY OF THE INVENTION

BACKGROUND OF THE INVENTION

The present closure is an improvement on tamper-proof twist-off closures of the type disclosed in Henning, U.S. Pat. No. 5,263,600 and pending Henning application Ser. No. 08/697,426. The twist-off closure of the present invention is effective to provide a tamper-evident closure for a bottle or other container such that the closure, once removed, cannot be reapplied to the bottle in its original locked and sealed condition. The closure thus provides and unmistakable warning that a bottle has been previously opened. The present improved twist-off closure also provides the desirable operating characteristics of the prior art Henning closure of application Ser. No. 08/697,426 in that it can be applied with conventional capping equipment to provide a tight seal. Moreover, the closure is not accidentally dislodged when subjected to internal bottle pressures of the order normally encountered. Moreover, the closure can be removed utilizing an acceptable torque in a manner readily apparent to even an inexperienced user. It is a principal object of the present invention to provide an improved closure having these desirable attributes while at the same time having a greatly reduced tendency to rust.

In accordance with the principles of the present invention, the present closure incorporates two features which function to minimize rusting. The first feature is the utilization of tabs having a greater spacing between them in the area where the tabs merge with the skirt of the cap. This spacing permits an increase flow of air under the tabs and along the bottom of the skirt during the air drying operation of a bottle following pasteurization.

In accordance with the principles of the present invention, the closure having this increased spacing between the tabs can, nevertheless, be handled in a bulk fashion as is customary from the time the cap is initially formed until it is fed to the capping machine in the bottler's plant.

More particularly, it is customary in the industry to form closures in a die located at a closure manufacturer's plant.

These closures, after they are ejected from the die, are transported in bulk to a feeder which feeds the closures to a machine which forms a liner by applying a suitable thermoplastic sealing compound to the undersurface of the top of the cap. This material forms a resilient annular liner which ultimately provides a seal between the cap and a lip on the bottle when the cap is in its closed position. After the sealing material has been deposited to form the liner, the caps are packaged in bulk and transported to the bottler. At the bottler's the caps are fed from their bulk containers to a capping machine which applies the caps to the individual filled bottles.

It is an important feature of the present closure construction that while the closure provides an increased spacing between the tabs adjacent to the closure skirt, the closures nevertheless can be effectively handled and transported in bulk without becoming entangled with one another.

In accordance with the present invention, this combination of desirable results is achieved by providing tabs which are of relatively narrow width throughout their length except for projections at the free ends of the tabs. In a preferred embodiment, these projections form the cross arm of a "T". Thus, the tabs are T-shaped with an elongated stem joined to the skirt and a cross arm at the free end of the stem. As a result of this configuration, enlarged spaces are provided for the entrance of drying air in the area where the tabs and skirt join, and yet only a small clearance is provided at the free ends of the tabs to prevent the tabs of one cap from becoming interleaved with the tabs of a second tab so as to cause jamming in bulk handling equipment.

In accordance with the present invention, the caps incorporate a second feature which further inhibits rusting of the edges of the tabs and the edge of the skirt. This aspect of the invention involves provision of pinch-trimmed edges along the periphery of the tabs and the exposed edge of the skirt. The effect of these pinch-trimmed edges is to provide a protective covering of tin and/or varnish over much of what would otherwise be exposed steel edges of the skirt and tabs.

More particularly, as is well-known by those skilled in the art, closures are conventionally made from a material comprising sheet steel which is coated with tin on both sides. On one side of the sheet, the tin is in turn coated with a thin laquer coating, while on the other side of the sheet the tin is coated with a thin layer of varnish. If such a material is blanked in a conventional die, the exposed peripheral edges of the closure include a sizeable area of steel. It is believed that the rusting problems encountered in prior art caps of the type referred to above occurred because this exposed steel edge was not adequately dried following immersion in a hot water bath. This problem is believed to be substantially alleviated by the novel configuration of the present closure tabs as described above.

In addition, however, we have determined that rusting can further be minimized by the utilization of pinch-trimmed edges on the tabs and skirts. These pinch-trimmed edges are formed by utilizing a blanking die which has a small radius on the corner on the female die member instead of a sharp right angle corner. This small radius functions to reduce the thickness of the cut edge of the closure makeup and to draw the tin plate and varnish around a portion of the exposed steel edge. This minimizes the exposed steel edge which is now substantially encased in a protective coating of tin and/or varnish.

These and other objects and advantages of the present invention will be more readily apparent from a consideration of the following detailed description of the drawings illustrating a preferred embodiment of the invention.

DETAILED DESCRIPTION OF A PREFERRED EMBODIMENT

Figure 1:
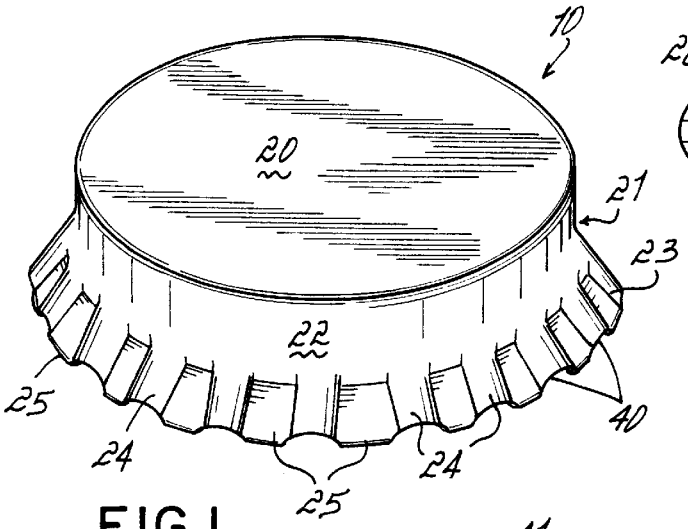
FIG. 1 is a perspective view of a closure constructed in accordance with the principles of the present invention, the closure being in its formed condition before application to the bottle top.

The overall construction of a closure or cap 10 embodying the present invention is shown in FIG. 1. Various details of construction of the cap are shown in FIGS. 2, 3, 4, 5 and 6. The present cap is adapted for use with bottles and other containers, such as those illustrated in FIGS. 7–11.

While the construction of the bottle does not constitute part of the present invention, an understanding of the general construction of the bottle is necessary to understand the functioning of the present closure. As shown in FIGS. 7–11, one form of container suitable for use with the present closure includes a neck 11 terminating in an annular sealing lip 12 at its uppermost edge. The lip 12 surrounds a central pouring opening 13 which extends downwardly through the neck. The outer periphery of the neck is configurated to form a ledge 14 extending inwardly from a peripheral wall 15 to a small diameter tapered wall portion 18 of the neck.

A plurality of cams 16 are formed about the periphery of the neck below ledge 14. In the exemplary bottle shown in FIG. 9, four cams 16 are provided. Each of the cams 16 includes a generally vertical working surface 17 extending from an area adjacent to the inner diameter of ledge 14 to a maximum diameter portion 19 spaced radially outwardly beyond the maximum diameter of the ledge 14. Ledge 14 and cams 16 are adapted to cooperate with tabs formed on a closure 10 to secure the closure in a sealed position and to facilitate disengagement of the closure from the bottle when the closure is opened by rotation. It is to be understood that the details of construction of the bottle constitute no part of the present invention. The present closure can be used with containers which differ in detail from the bottles shown.

Figure 4:
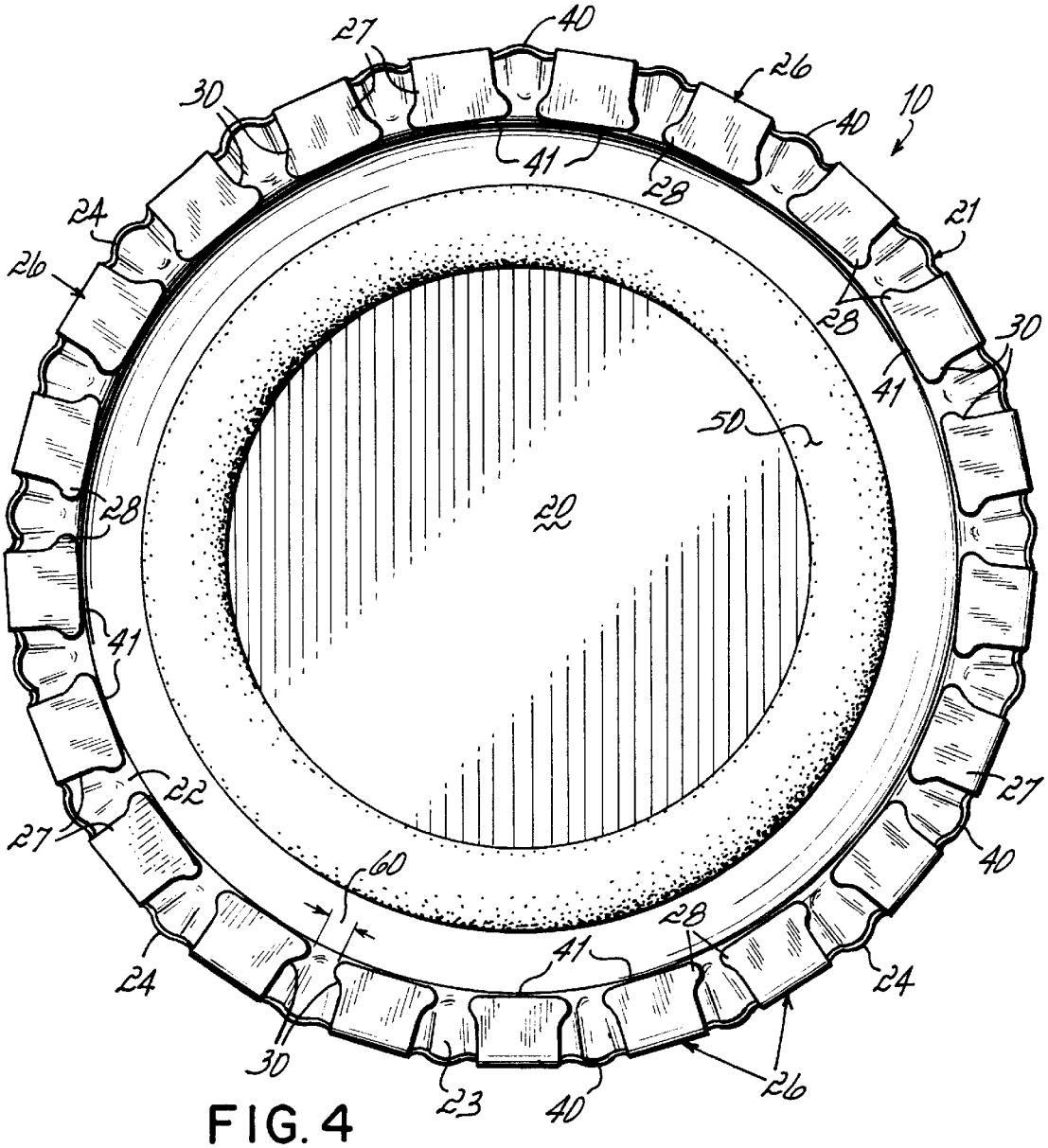
FIG. 4 is a bottom elevational view of the closure shown in FIG. 1.
Figure 5:
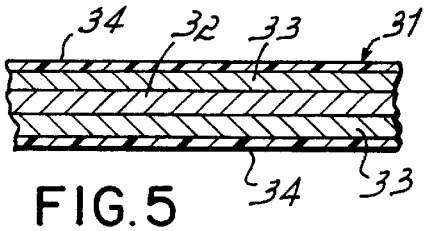
FIG. 5 is a cross-sectional view of the sheet from which the present cap is formed.

The overall construction of a preferred form of closure 10 is best shown in FIGS. 1 and 4. As they are shown, the closure comprises a generally circular top wall 20 surrounded by a depending peripheral skirt 21. Skirt 21 includes a generally vertical wall section 22 which has an outwardly flared lower portion 23. To compensate for the excess material from the diameter reduction during forming of the crown, a plurality of spaced corrugations 24 are formed in the lower portion of the vertical wall section 22 and flared portion 23 which also act to stiffen the flared portion 23. Corrugations 24 are of generally U-shaped configuration and are separated from one another by a plurality of webs 25 which extend between adjacent corrugations 24.

Figure 3:
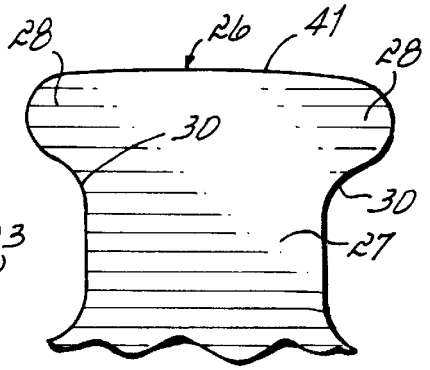
FIG. 3 is an enlarged plan view of the circled area 3 of FIG. 2 illustrating a locking tab of the present invention.

The cap 10 further comprises a plurality of tabs 26 which extend from the outer portion of webs 25. As best shown in FIGS. 3 and 4, each of the tabs is an elongated flat member having a stem portion 27 terminating in one or more endwise protuberances 28. In the preferred embodiment, protuberances 28 form portions of the cross arm of a "T". Thus, the tab has an overall T-shape formed by the stem 27 and the cross arm including protuberances 28. As shown in FIGS. 3 and 4, the outer edges of the cross arm or protuberances are rounded and are joined to the stem portion 27 by curved sections 30.

Figure 2:
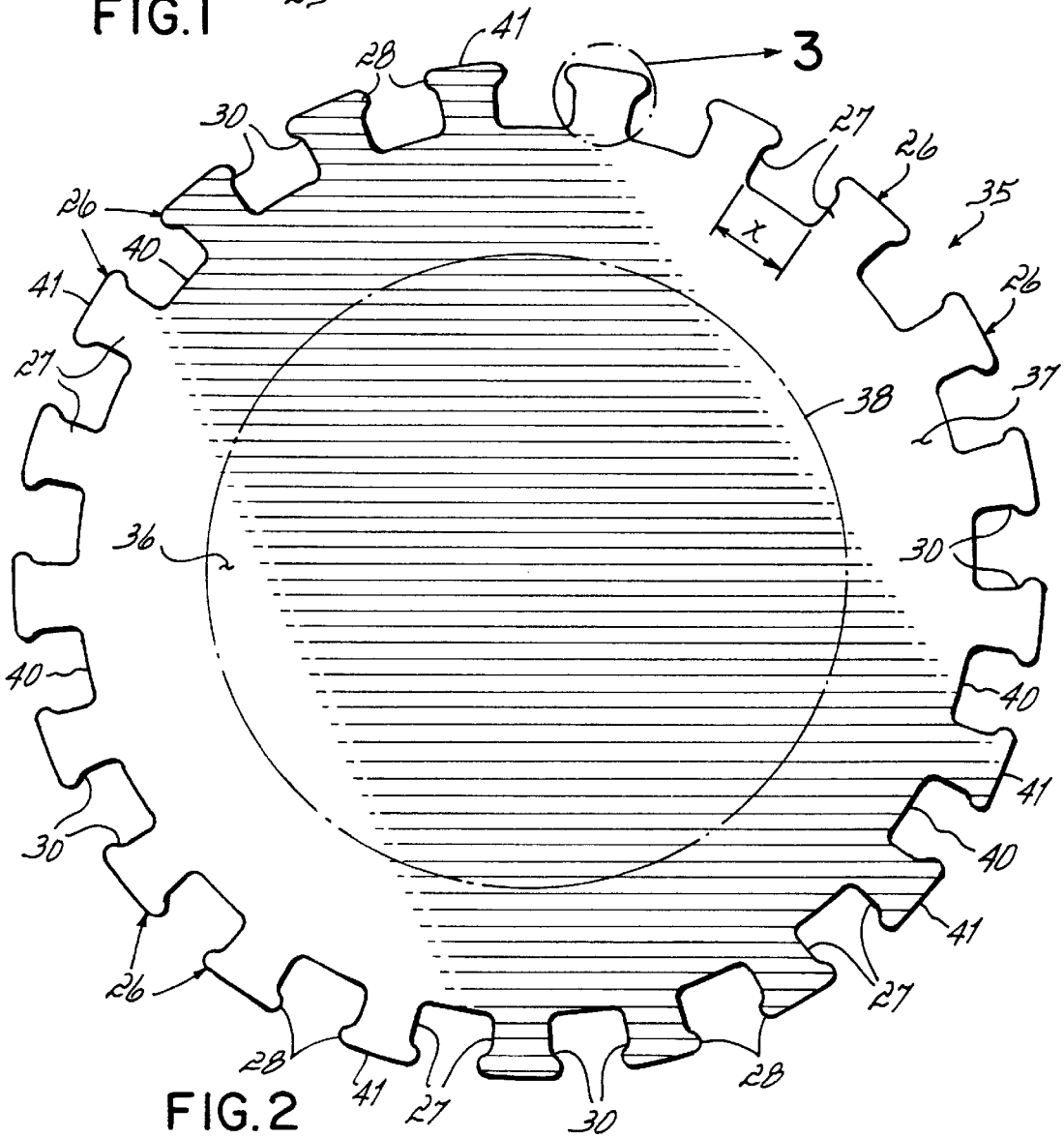
FIG. 2 is a top plan view of a blank for forming a closure of the present invention.

The cap is preferably formed from a conventional 0.010" thick coated sheet material 31 comprising a steel sheet 32 coated on each side with a tin coating 33. The tin coating on one side of sheet 32 is covered by a varnish or laquer layer 34 (See FIG. 5). The tin coating on the other side of sheet 32 is also covered with a varnish or laquer layer 34. A blank 35, shown in FIG. 2, is formed from a sheet of steel coated as described. The blank 35 comprises a generally circular section 36 which forms the top wall 20 of the cap. Circular section 36 is surrounded by a generally annular section 37 which forms skirt 21 including wall 22, corrugations 24 and webs 25. In forming the cap, the skirt is bent downwardly from the central portion 36 along a circular line 38. Twenty-one tabs 26 are equally spaced about the circular edge 40 of the blank which forms the lower edge of the cap, as indicated in FIG. 1. In a preferred embodiment, the diameter of circular edge 40 is 1.408 inches. The maximum diameter of the blank between outer edges 41 of tabs 26 is 1.608 inches. The width of stem sections 27 is 0.090 inches. The width of T-shaped cross arm of tabs 26 is 0.140 inches, while the spacing "x" between adjacent tabs at their juncture with edge 40 is 0.100 inches. It will, of course, be understood that these dimensions can be varied depending upon such factors as the size of the bottle, the neck to which the cap is to be applied, etc.

Figure 6:
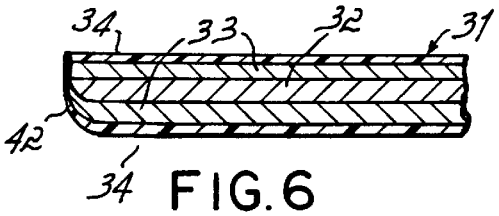
FIG. 6 is a semi-diagrammatic cross-sectional view through a sheared edge of the cap.

The closures of the present invention are preferably manufactured utilizing the method and apparatus disclosed in the pending patent application of Mark E. Melson, Ser. No. 08/627,756, entitled METHOD AND APPARATUS FOR MAKING A TAMPER-EVIDENT CROWN, the disclosure of which is incorporated herein by reference in its entirety. In accordance with the present invention, that apparatus is modified so that all exposed edges of the cap are pinch trimmed, as shown in FIG. 6. More particularly, the entire periphery of each of the tabs 26 and circular edge 40 which forms the lower exposed edge of the cap are pinch trimmed. As shown in FIG. 6, the pinch trimmed finish of these exposed edges results in the outer tin coating layer 33 and varnish or lacquer layer 34 being partially drawn across the outer edge of steel sheet 32. This edge has been tapered as shown at 42 in FIG. 6. Consequently, only a minimal area of sheet 32 may be exposed along the edges. The protective edge coating of tin and varnish or lacquer substantially reduces corrosion in this area.

Figure 15:
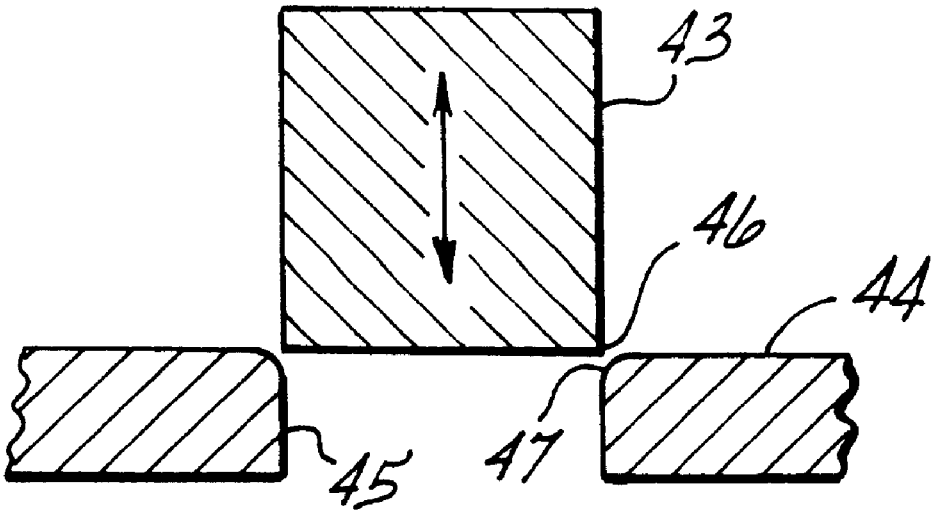
FIG. 15 is a diagrammatic cross-sectional view of a pinch trim blanking die forming the closure edges illustrated in FIG. 6.

As disclosed in detail in the above-identified Melson application Ser. No. 08/627,756, the first step in producing a cap 10 is to form a blank 35 from a sheet of material. This is accomplished utilizing a punch or a male die member and a female die member which are reciprocated relative to one another. In accordance with the present invention, the male blanking die member, or punch, is modified about the entire periphery of the blank. This modification is shown diagrammatically in FIG. 15. As there shown, a punch 43 is reciprocated with respect to a female die member 44. As will be appreciated by those skilled in the art, the periphery of punch 43 and the corresponding inner wall 45 of the female die member 44 are configurated to correspond to the outline of blank 35 shown in FIG. 32. These members, however, differ from a conventional punch and die set in that the lower corners 46 of the punch are sharp and square, while the cooperating upper corners 47 of the female die member which receives the punch 43, are rounded, preferably at a radius of 0.03 inches. When the punch is driven downwardly through a sheet of material like that shown in FIG. 5 and a blank 35 is punched out, the peripheral edges have a radius on the lower side of blank 35 with a layer of tin and varnish or lacquer being rolled over the peripheral edge to effectively coat a portion of the peripheral edge of the blank and thereby minimize subsequent corrosion (See FIG. 6).

The die disclosed in Melson application Ser. No. 08/627,756 is a compound die which in a single stroke produces a cap of the configuration shown in FIGS. 1 and 4. As there shown, walls 22 of the cap extend generally vertically downwardly from top wall section 20 with portions 23 of the cap being flared outwardly. Each tab 26 is bent inwardly along line of juncture of stem 27 with lower circular edge 40. Preferably, the tabs extend inwardly and upwardly from the periphery of the cap at a slight angle, for example, 10° to horizontal (See FIG. 12).

In accordance with conventional practice, the caps are ejected from the die in the configuration shown in FIG. 1 and are discharged into bulk containers. The caps are transported to equipment for applying a resilient liner, such as liner 50. In the embodiment shown, liner 50 is an annular ring formed of a thermoplastic material adhered to the undersurface of top wall 20 of the cap. After the liners 20 are applied to the caps, the caps are again discharged randomly into bulk storage containers in which the caps are transported to the bottling plants. In the bottling plant, caps are dumped from the bulk storage containers into a feeder which supplies the caps to a capping machine.

Figure 12:
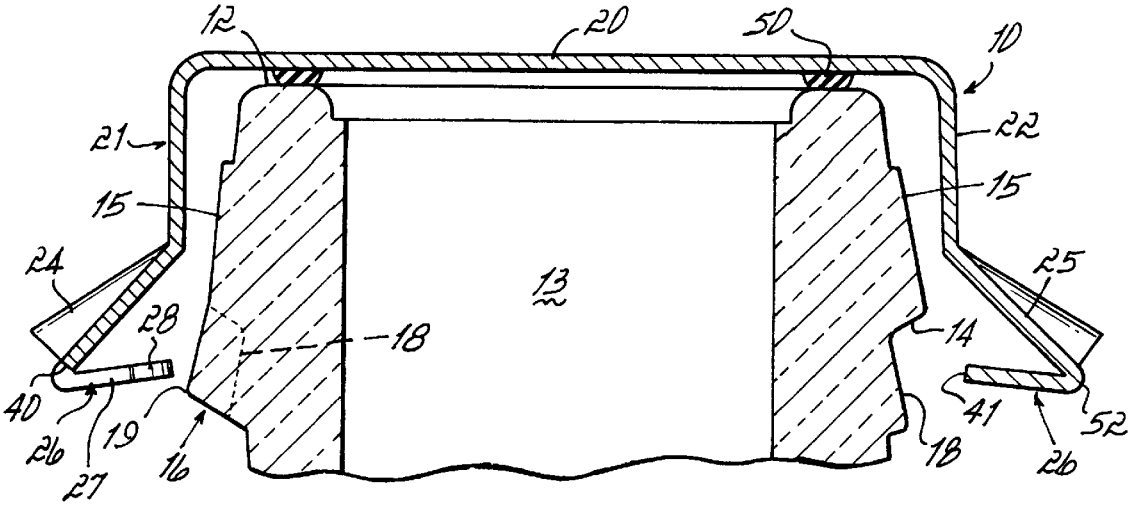
FIG. 12 is a vertical cross-sectional view through a bottle neck taken along line 12—12 of FIG. 9 with a closure like that shown in FIGS. 1 and 4 positioned in contact with the sealing rim of the bottle at the start of a capping operation.
Figure 13:
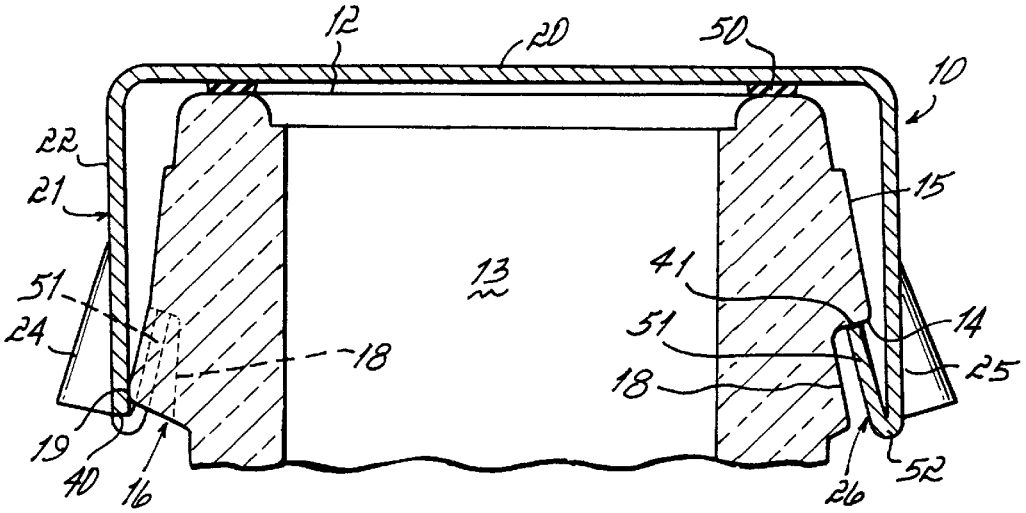
FIG. 13 is a cross-sectional view similar to FIG. 12 showing the tabs of the closure in a position in which they have been forced inwardly and upwardly against the under surface of the bottle ledge so that the closure is sealed and locked onto the bottle.
Figure 14:
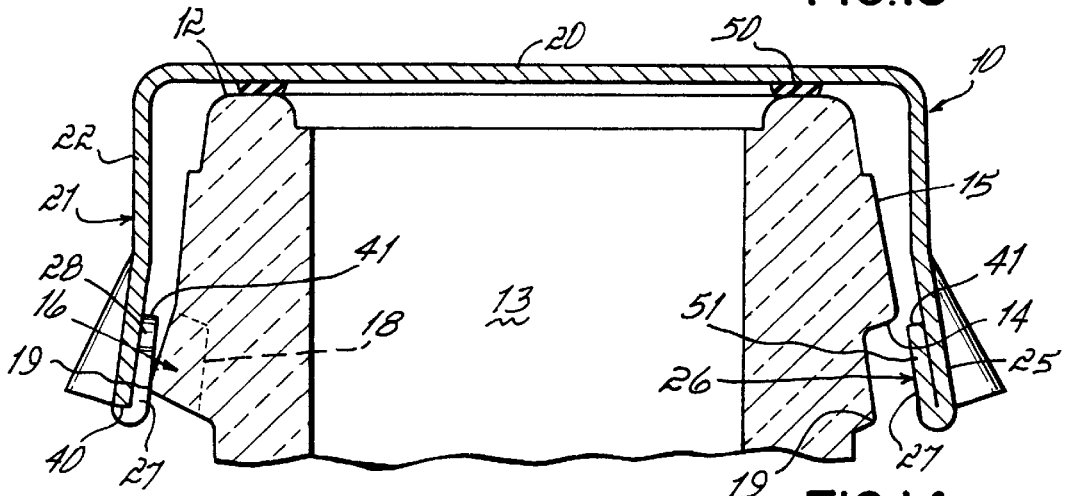
FIG. 14 is a cross-sectional view similar to FIG. 13 in which the closure has been twisted to disengage the tabs from the bottle lips, freeing the cap to be lifted from the bottle.

The manner in which a cap of the present invention is applied to a bottle and the manner of cooperation of the tabs on the cap with the ledge and ramps of the bottle is illustrated in FIGS. 12–14. More particularly, FIG. 12 shows a cap 10 as it is initially placed over the sealing lip 12 of a bottle. Liner 50 contacts the rim, while the cap 10 and tabs 26 surround the neck of the bottle in spaced relationship thereto. It is to be understood that the caps are applied to the bottles using a generally conventional capping machine of the type well-known to those skilled in the art for applying crown top closures. These machines incorporate an annular plunger which is shifted downwardly over the cap to engage the depending skirt 21 of the cap. As the plunger is advanced downwardly over the bottle, liner 50 is compressed and the skirt is pressed inwardly to reduce the flare from that shown in FIG. 12 to that shown in FIG. 13. As the skirt is forced inwardly, tabs 26 are shifted inwardly and upwardly from their position shown in FIG. 12 to their position shown in FIG. 13. As a result, the outer peripheral or transverse edges 41 of most of the tabs are brought into engagement with ledge 14.

FIG. 13 shows a cap in its completely sealed and locked position. In this position, the upwardly bent portions 51 of tabs 26 are placed in compression, while the portions of the tabs and skirt beyond V-shaped bend 52 are placed in tension. As a result, a downward force applied during capping is maintained on the cap causing the top wall 20 to hold liner 50 tightly against sealing lip 12 of the bottle. The stems 27 of the tabs are dimensioned so that they do not buckle in the closed position of FIG. 13 even when a maximum design pressure is present within the bottle.

In order to remove a cap 10 from the bottle, the user rotates the cap in a counter-clockwise direction approximately 90°. As the cap is rotated, tabs 26 are cammed outwardly by the vertical working surfaces 17 of the cams 16. During this motion, the tabs are bent to the position shown in FIG. 14 in which the stems 27 of the tabs 26 are brought closely adjacent to and substantially parallel with webs 25. The webs 25 are also bent slightly outwardly, as is shown in FIG. 14. As a result, a substantial horizontal clearance is created between the innermost surfaces of tabs 26 and the maximum diameter of ledge 14. This is shown in FIG. 14, in which all portions of tabs 26 are disposed radially outwardly of ledge 14, and indeed, any other portion of the bottle disposed between the radially outermost portion 19 of cams 16 and the sealing lip 12 of the bottle.

When a cap has been rotated 90° to the position shown in FIG. 14, it is retained on the bottle only by the frictional engagement of a few tabs with cams 16. In this condition of the cap, it is readily apparent to even a casual user that the cap has been loosened and can readily be removed by simply lifting it from the bottle. There is no appreciable resistance to this upward removal of the cap.

After the cap 10 has been removed, portions 51 of the tabs remain bent upwardly in substantially the position shown in FIG. 14. If an attempt is made to reapply the cap 10 to a bottle, it is impossible to re-lock the cap in position. More particularly, it is impossible, without the use of complicated equipment, to push the tabs 26 back into locking engagement with the ledge 14, as shown in FIG. 13. Thus, as a practical matter, all that can be done with the cap is to place it back over the end of the bottle in the position shown in FIG. 12. In that position, the cap is very loose and the tabs are bent outwardly against the skirt giving a clear visual warning that the cap has previously been removed and that the contents of the container may have been tampered with.

Figure 7:
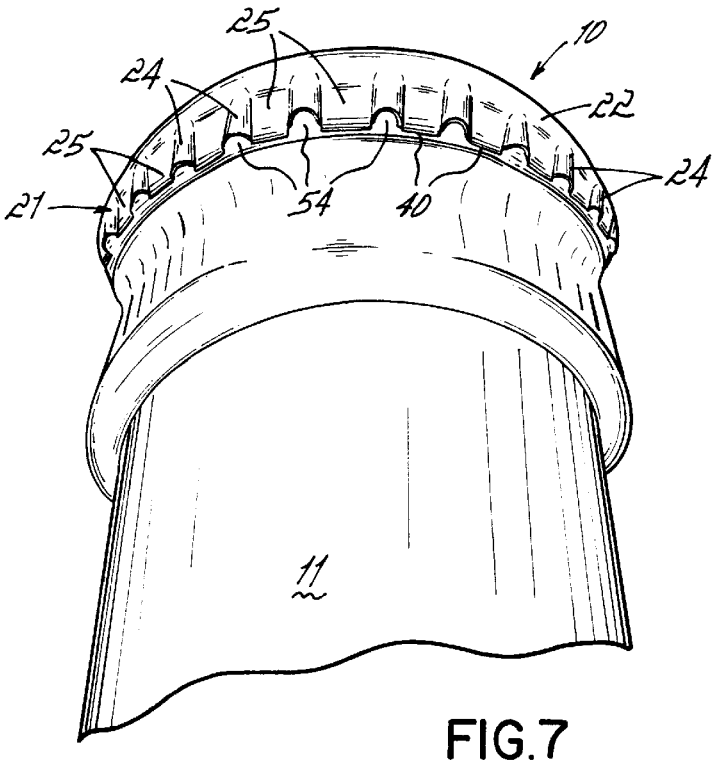
FIG. 7 is a perspective view of the neck of a bottle with a cap of the present invention in a sealed position.
Figure 10:
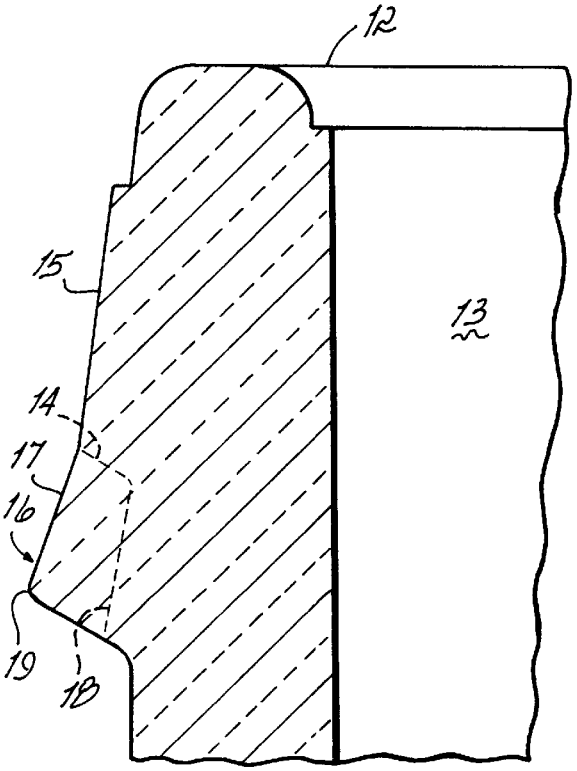
FIG. 10 is a cross-sectional view taken along line 10—10 of FIG. 9.
Figure 11:
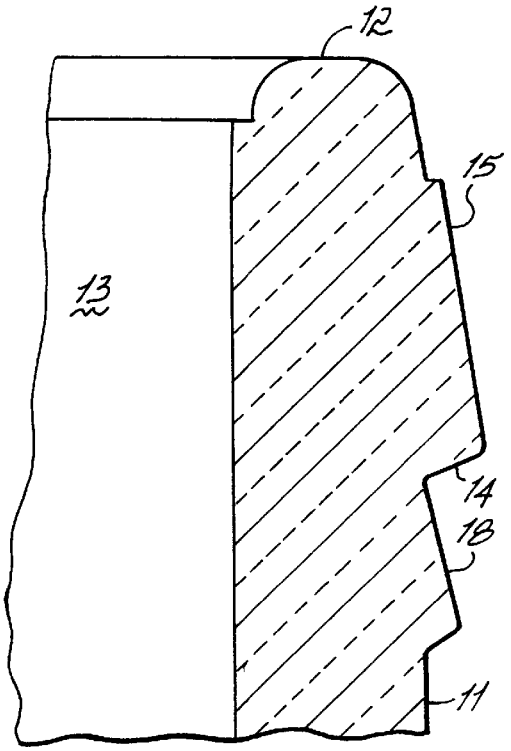
FIG. 11 is a cross-sectional view taken along line 11—11 of FIG. 9.
Figure 8:
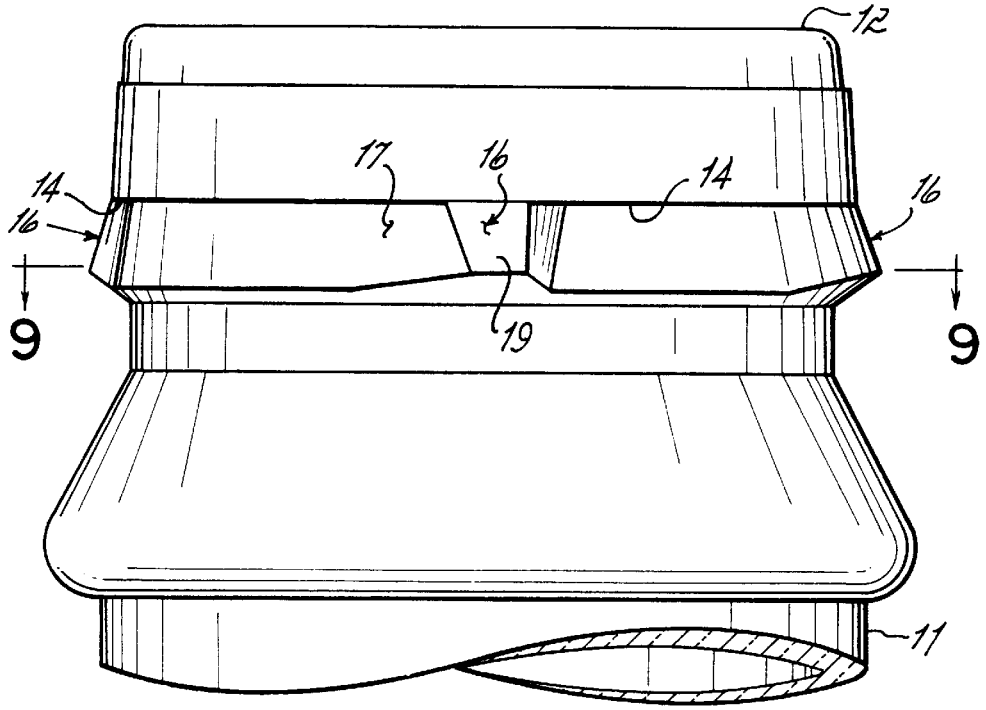
FIG. 8 is a side elevational view of a preferred form of bottle for use with the present cap.
Figure 9:
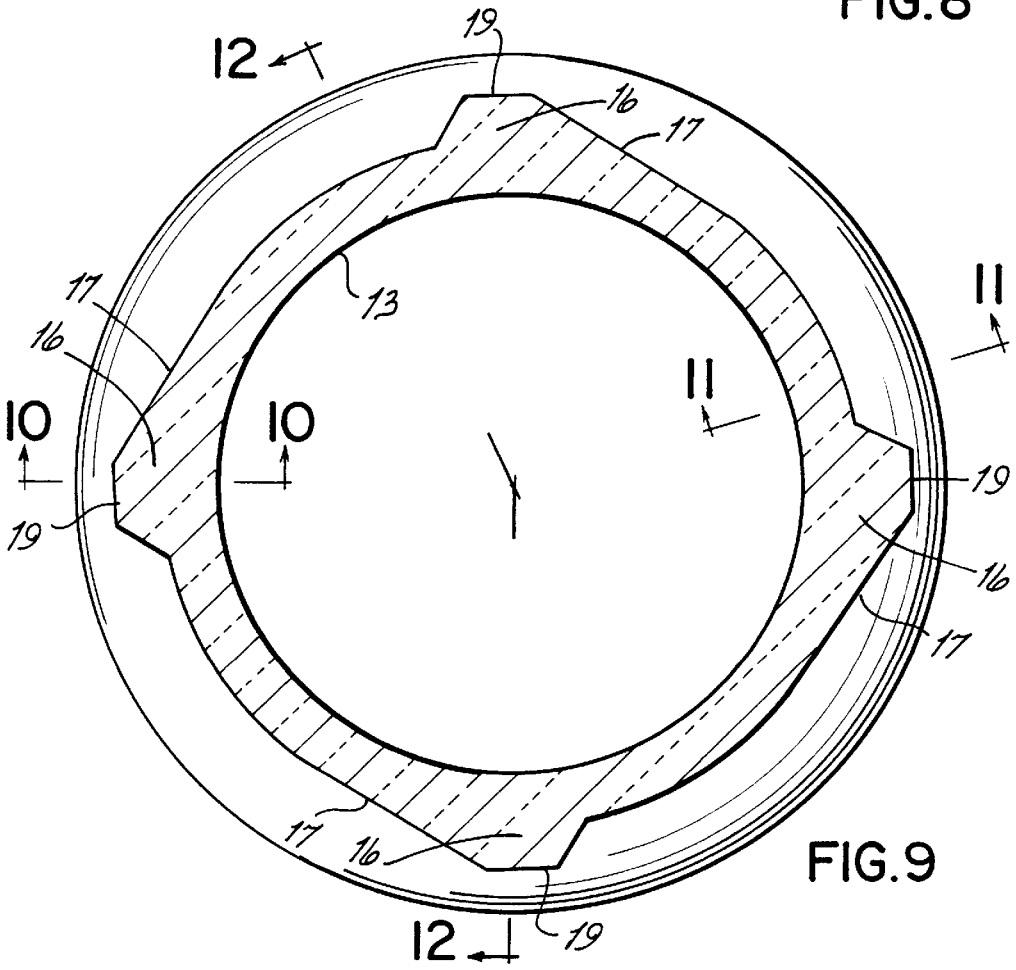
FIG. 9 is a cross-sectional view taken along line 9—9 of FIG. 8.

In a conventional bottling operation, after a cap has been applied to the bottle, it is customary to pass the bottles through a bath of hot water to pasteurize the product. After the bottles emerge from the bath, jets of hot air are directed along the ledge 14 of the bottle upwardly against the cap. These air jets would be directed upwardly against the cap 10 in the area of its contact with the neck 11 of a bottle, as shown in FIG. 7. In accordance with the present invention, enlarged openings 54 are formed intermediate the stems of adjacent tabs 26. These openings permit improved air flow under the skirt of the cap to dry off the exposed edges of the tabs and lower portion of the skirt. The enlargement of these openings is facilitated by the decrease in the width of the stems 27 of individual tabs and the corresponding increase in the spacing "x" between adjacent tabs (See FIG. 2).

At the same time that increased spacing is provided between the tabs in this area, the spacing 60 between the free ends of adjacent tabs in the pre-capping configuration of the closure shown in FIGS. 1 and 4, is substantially unchanged. Maintaining this spacing is effected by the provision of protuberances 28, or in the preferred embodiment the cross arms of the T-shaped tabs. The result of keeping a small distance between the free ends of the tabs prevents the tabs from becoming entangled with one another during bulk handling and storage of the closures as described above.

From the foregoing disclosure of the general principles of the present invention and the above description of a preferred embodiment, those skilled in the art will readily comprehend various modifications to which the invention is susceptible. Thus, for example, it is contemplated that a greater or lesser number of tabs can be provided on the cap and that the cap may be used with a bottle of different configuration from that shown in the enclosed drawing. Therefore, we desire to be limited only by the scope of the following claims.

We claim:

1. A twist-off closure for a container of the type having a neck with a central pouring opening and an outer sealing lip surrounding the end of said neck and a ledge surrounding said neck adjacent to said lip, said closure comprising:

a top wall;

a depending peripheral flange, said flange being configured to form a plurality of corrugations and a plurality of webs interconnecting said corrugations, said webs having lower-most edges;

tabs extending from said webs, each of said tabs having an elongated stem portion joined to said web and a free end, said stem portion being narrower than said web;

lateral protuberances extending transversely of said stem portion adjacent to said free end;

said tabs being bent inwardly and upwardly from the lower-most edges of said webs, the free ends of said tabs being disposed adjacent to an intermediate portion of said webs, the spacing between adjacent tabs forming a passageway for drying air, said protuberances reducing the spacing between said free ends of adjacent tabs without restricting said air passageways.

2. The closure of claim 1 in which two protuberances extend from opposite sides of said stem adjacent to the free end thereof.

3. The closure of claim 1 in which said tabs are T-shaped and said protuberances form a cross arm adjacent to the free end of said stem.

4. The closure of claim 3 in which said closure is formed from a steel sheet, and a corrosion-resistant coating, the peripheral edges of said closure being formed by pinch trimming, and the corrosion-resistant layer substantially covering the edge of said steel sheet.

5. The closure of claim 4 in which said corrosion-resistant coating comprises a tin coating.

6. The closure of claim 5 further comprising a lacquer coating over said tin coating.

7. The closure of claim 3 in which said closure is formed from a steel sheet and a corrosion-resistant layer, said closure being formed by pinch trimming and the corrosion-resistant layer substantially covering the edge of said sheet.

8. The closure of claim 1 in which said closure is formed from a steel sheet and a corrosion-resistant coating, said closure being formed by pinch trimming and the corrosion-resistant layer substantially covering the edge of said sheet.

9. The closure of claim 1 in which said tabs are bent upwardly at an angle of the order of 10° above horizontal.

10. The closure of claim 9 in which said closure is formed from a steel sheet, and a corrosion-resistant coating, the peripheral edges of said closure being formed by pinch trimming, and the corrosion-resistant coating substantially covering the edge of said steel sheet.

11. A twist-off closure for a container of the type having a neck with a central pouring opening and an outer sealing lip surrounding the end of said neck and a ledge surrounding said neck adjacent to said lip, said cap comprising:

a top wall;

a depending peripheral flange, said flange being configured to form a plurality of corrugations and a plurality of webs interconnecting said corrugations, said webs having lower-most edges;

tabs extending from said webs, each of said tabs being T-shaped and having an elongated stem portion joined to said web and a free end, said tabs being narrower than said web;

a transverse arm extending transversely of said stem portion adjacent to said free end;

said tabs being bent inwardly and upwardly from the lower-most edges of said webs, the free ends of said tabs being disposed adjacent to an intermediate portion of said webs, the spacing between adjacent tabs forming a passageway for drying air, said transverse arms reducing the spacing between said free ends of adjacent tabs without restricting said air passageways.

* * * * *